US005577316A

United States Patent [19]

Kaelin

[11] Patent Number: 5,577,316

[45] Date of Patent: Nov. 26, 1996

[54] METHOD FOR PRODUCING A MINI-TRANSFORMER WITH MOLDED COVER AND RETENTION STRUCTURE

[75] Inventor: Ruedi Kaelin, Seon, Switzerland

[73] Assignee: Aspro Technology AG, Wildegg, Switzerland

[21] Appl. No.: 465,008

[22] Filed: Jun. 5, 1995

Related U.S. Application Data

[62] Division of Ser. No. 310,034, Sep. 21, 1994, Pat. No. 5,483,405, which is a continuation of Ser. No. 787,006, Nov. 4, 1991, abandoned.

[30] Foreign Application Priority Data

Nov. 7, 1990 [CH] Switzerland ..... 3536/90
Sep. 26, 1991 [CH] Switzerland ..... 2853/91

[51] Int. Cl.[6] ..... H01F 41/02

[52] U.S. Cl. ..... 29/606; 29/602.1; 264/272.19

[58] Field of Search ..... 29/602.1, 606, 29/605; 336/98, 96; 264/272.19

[56] References Cited

U.S. PATENT DOCUMENTS 3,665,358 5/1972 Leuck et al. .
3,813,763 6/1974 Church .
4,107,636 8/1978 DiGirolamo .

FOREIGN PATENT DOCUMENTS 565112 7/1960 Belgium .
1140988 12/1962 Germany .
2441864 4/1975 Germany .
845780 8/1960 United Kingdom .
WO91/14274 9/1991 WIPO .

*Primary Examiner*—Carl E. Hall
*Attorney, Agent, or Firm*—Frishauf, Holtz, Goodman, Langer & Chick, P.C.

[57] ABSTRACT

A mini-transformer features an iron or ferrite core (2) and primary and secondary windings (3, 4). Portions of the windings (3, 4) which extend beyond the iron or ferrite core (2) are covered on both sides with a thermoplastic material forming a lid (6, 7). The two lids or end bells (6, 7) are combined into one piece by means of first bars (12), which extend through the hollow spaces (9) between the windings (3, 4) and the iron or ferrite core (2) and fill them, and that the laminated iron or ferrite core (2) is fixed in itself by second bars (14) connecting the two lids (6, 7).

7 Claims, 5 Drawing Sheets

METHOD FOR PRODUCING A MINI-TRANSFORMER WITH MOLDED COVER AND RETENTION STRUCTURE

This is a division of application Ser. No. 08/310,034, filed Sep. 21, 1994, now U.S. Pat. No. 5,483,405, which is a continuation of Ser. No. 07/787,006, filed Nov. 4, 1991 (abandoned).

FIELD OF THE INVENTION

The invention relates to mini-transformers or small transformers having an iron or ferrite core, and primary and secondary windings, and to a method of its production, for example of power ratings of between 0.2 to 400 VA. The term "mini-transformer" or "small transformer" is intended to distinguish the field of application of the present invention from large transformers, for example utility distribution transformers, high voltage stepdown transformers and the like.

BACKGROUND

It is already known to produce mini-transformers which are wholly potted, where the entire iron core including coils is surrounded on the outside by a plastic housing. A hardenable plastic is filled in from an open housing side, so that the transformer is completely surrounded by plastic up to the rim of the housing. However, the fact that a relatively large amount of plastic is needed is a disadvantage, as is the cumbersome and slow production method, because two-component plastics, which are suited for this purpose, harden only slowly over a period of hours. A further disadvantage lies in the poor way heat is conducted away, because the plastic layer surrounds the iron core on all sides.

THE INVENTION

It is an object to provide a mini-transformer and a method of its production which, in contrast to conventional embodiments, can be very efficiently produced with little effort, is suitable for mass production in large numbers and where, in spite of the crowded construction, safe electrical distances can be maintained without additional expenditure.

In accordance with the invention, the portions of the windings which extend beyond the iron or ferrite core are covered, in one plastic injection step, on both sides with a thermoplastic material forming a lid or cover on either side; the two lids are combined into one unitary plastic molding or piece by means of inner, or first bars, or connecting posts, which extend through the hollow spaces between the windings and the iron or ferrite core to fill the spaces and outer, and second bars, posts or strips which secure the laminated iron or ferrite core together, and further connect the two lids or covers. The lids or covers form end bells for the coils.

The transformer, and the method of its manufacture, has the advantage that the windings are fixed in relation to the iron or ferrite core, and are secure against displacement; and, further, the laminated iron or ferrite core elements are held compactly together, so that the otherwise customary riveting or welding of the core stack can be omitted. Heat dissipation from the core is preserved.

Application of plastic by injection to form the two lids and the first and second bars connecting the lids takes place in a single operation with comparatively little expenditure of plastic. A vibration-free product is thus created in which safe electrical distances can be reliably maintained.

DRAWINGS

The drawings illustrate exemplary embodiments of the subject of the invention, which will be described in detail below.

FIG. 1 shows the production steps of the mini-transformer in transformer in which illustration 1.1 is an exploded view of the core; illustration 1.2 is a schematic perspective view of the coil body with a winding thereon; illustration 1.3 is a perspective view of the coil body assembled in the core; and illustration 1.4 is a view of the coil body, core, and injection molded lids placed on the assembly shown in illustration 1.3;

DETAILED DESCRIPTION

The mini-transformer is intended to have an output of approximately 0.2 to 400 VA. It contains a laminated iron core 2 in the form of a core stack formed of layers of individual pieces of sheet metal. The iron core 2 contains stacked lamination 2' in the shape of a letter E, which are supplement by stacked lamination 2" to form the shape of a letter I. In the assembled state the laminated bundles in E and I—shaped abut directly on each other. The core 2 has flat broad end faces 52 and four side faces 54.

A variant embodiment, particularly when ferrite cores are used, consists in that both laminated bundles have E- shapes which touch each other and are respectively mirror-reversed.

Figure 1:
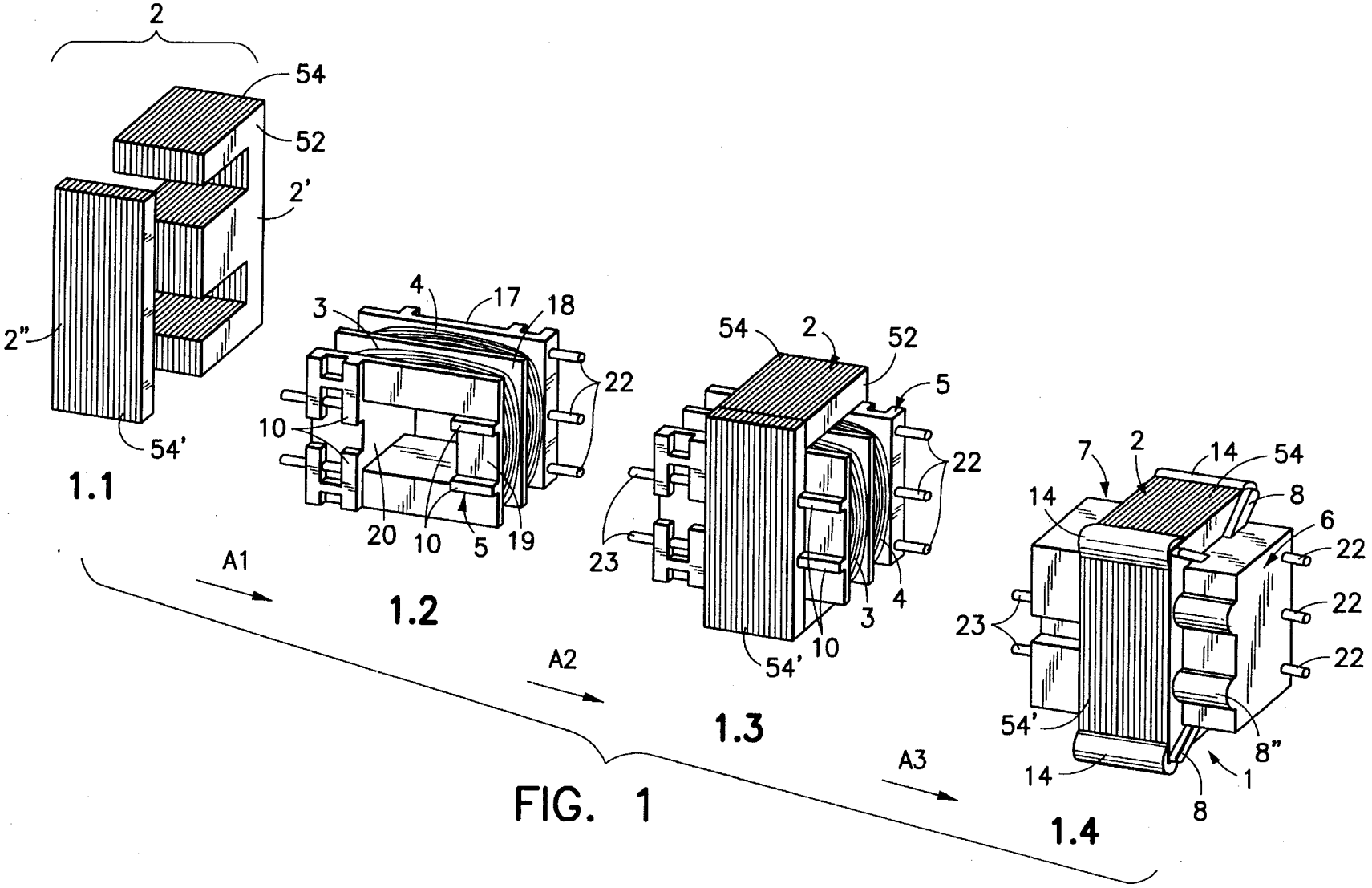
Figure 2:
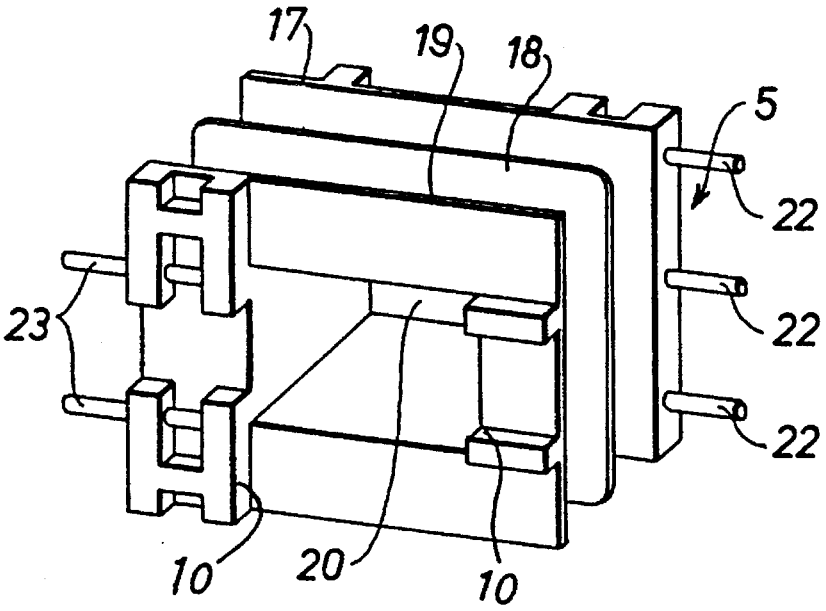
FIG. 2 shows a coil body in a perspective view.

The center leg of the E-stack 2' is inserted into the hollow space 20 of a coil body 5 and the I-stack 2" is subsequently added on the outside, as shown in FIG. 1. The two core stacks 2' 2" are supported by support ribs 10 of the coil body 5. A primary winding 3 and a secondary winding 4 are applied to the coil body 5 prior to the insertion of the iron core 2. These windings 3, 4 are maintained in the coil body 5 by support walls 17 and 19 (FIG. 2) and are separated from each other by a separating wall 18. The arrows A1, A2 & A3 (FIG. 1) illustrate sequential steps in the assembly and manufacturing process.

The two windings 3, 4 and the coil body 5 extend on both sides beyond the iron core 2.

Figure 3:
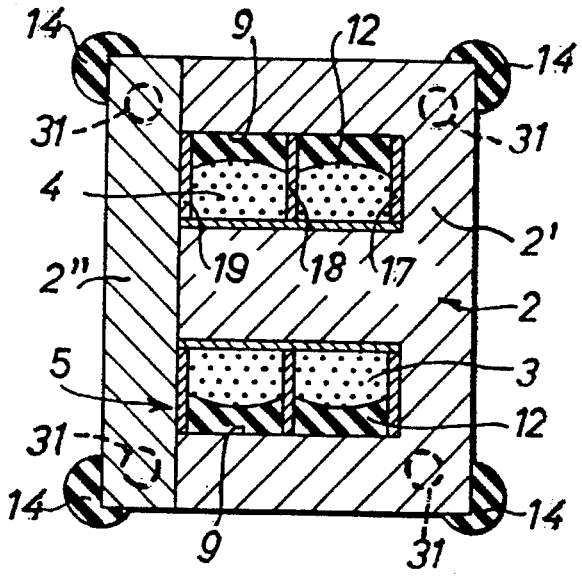
FIG. 3 shows a section through the mini-transformer of FIG. 1.

In accordance with a feature of the invention, a lid 6, 7 of a thermoplastic material, preferably polyamide, is applied by injection-molding over each one of the two winding portions which extend beyond the iron core 2. So that air can escape easily, the liquid plastic is injected only from one side, preferably from the center of one lid. The injected plastic penetrates the hollow chambers 9 between the windings 3, 4 and the iron of ferrite core 2 and forms first bars or posts, strips or connectors 12, as can be seen in FIG. 3. Because of this, the windings 3, 4 are secured vibration-freed inside the coil body 5, on the one hand, and on the other in the iron or ferrite core 2.

So that the iron or ferrite core 2 is also securely kept together and that welding seams or rivets, which would disturb the magnetic flux, are avoided, outer second bars 14, curved in cross section (see FIG. 3), are disposed on the exterior of the iron or ferrite core at the corners. These are connected with each of the two lids 6, 7 via ribs, posts or strips or connectors 8 to form one piece therewith.

In this way, the two lids 6, 7, together with the first and second bars 12, 14, form a single, integral piece of plastic. The sides of the lids are reinforced with ribs 8" to ensure that the lamination of the core are tightly secured together. Ribs 8" are preferably placed over the support ribs 10 of the core body 5.

If the core elements 2' and 2" are formed with holes 31 which, in prior art cores, have rivets or screws therein, the holes 31 can be filled also with plastic to form ribs or connectors similar to the outer ribs or strips or connectors 14. These respective posts, strips or connectors penetrate bores 31 on each corner of the iron or ferrite core 2.

Figure 4:
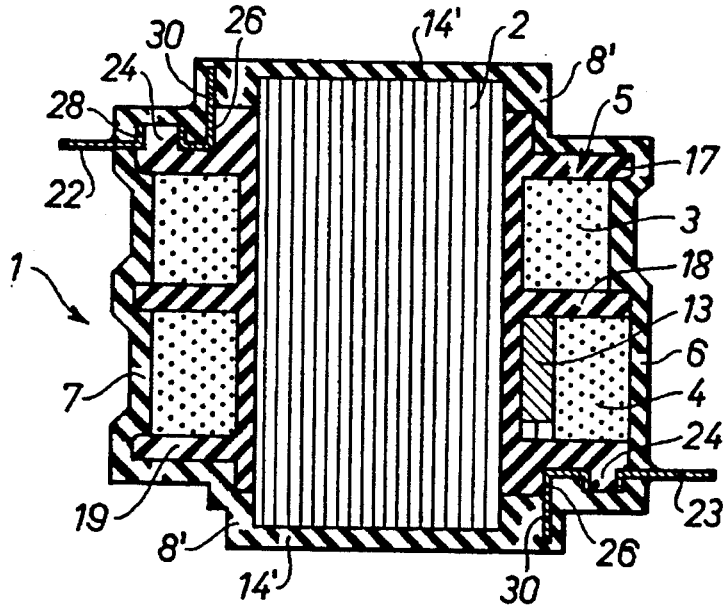
FIG. 4 shows a section along the line IV—IV of FIG. 5.
Figure 5:
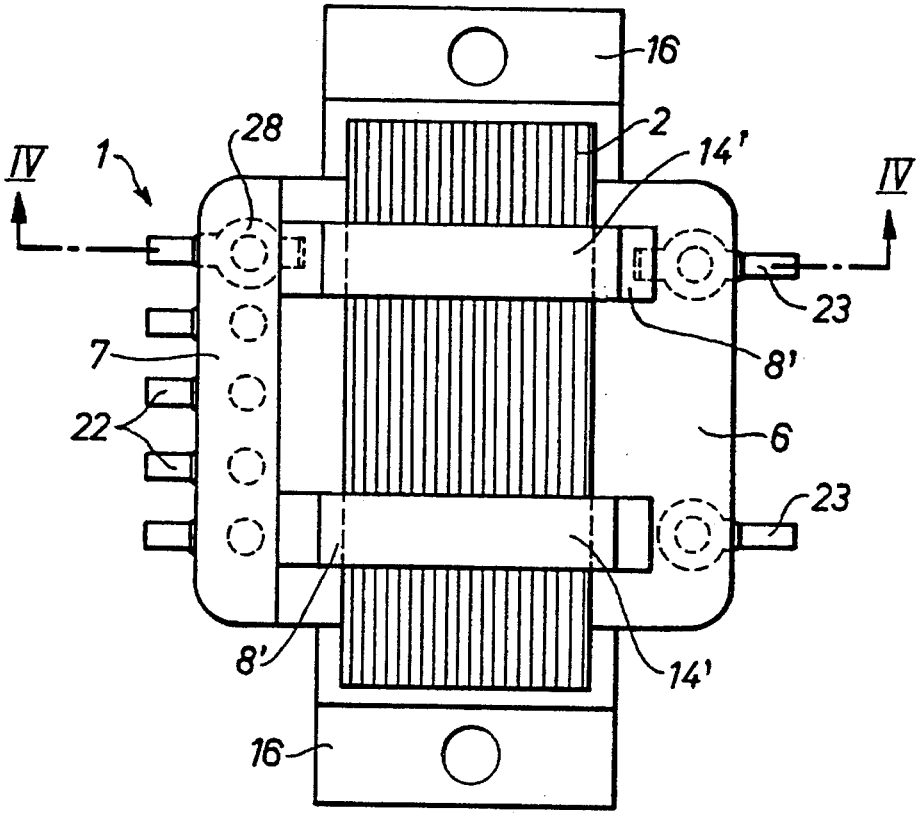
FIG. 5 shows a top view of a variant embodiment of a mini-transformer with a base.

In the embodiment in accordance with FIGS. 4 and 5 the second bars or connectors have the shape of flat straps 14' extending on the exterior over the iron or ferrite core 2, which are connected via connecting elements 8' with each one of the lids or covers 6, 7.

A thermal protection element 13 (FIG. 4) is installed in the coil body 5 as protection against excessive heat and may be either a switch, a fuse or a temperature sensor. The associated electrical contact pins or tongues 23 are cast into the lid 6 and project outwardly.

Figure 6:
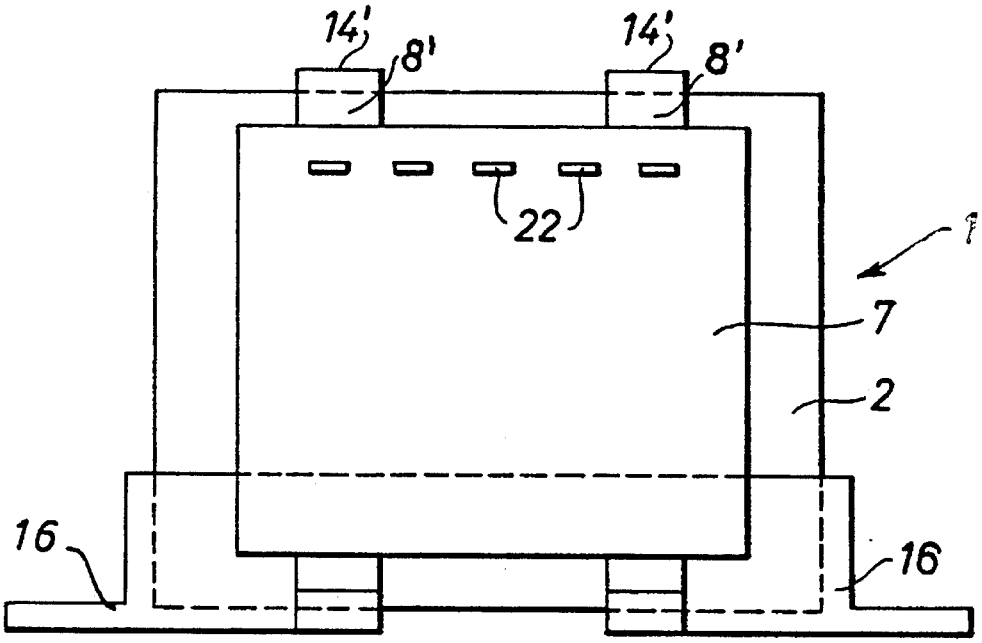
FIG. 6 shows a lateral view of the mini-transformer in accordance with FIGS. 4 and 5.

The embodiment in accordance with FIGS. 4 to 6 also shows a base 16 which is injection-molded as one piece on one of the lids or covers.

The electrical connecting wires or the coils 3, 4 are each connected to metallic connecting pins 22, 23 or flat tongues, which extend out of the lids 6, 7. For fastening these pins, lugs or tongues 22, 23, the coil body 5 contains an integrated fastening peg 24 and a stop edge 26. Each of the fastening pins or tongues 22, 23 has an apertured lug portion 28, which is placed over and engaged by the fastening peg 24, and a cropped tab 30 which abuts against the stop edge 26 and, in this way, prevents rotation.

The soldering joints for the connecting wires are embedded in the lids 6, 7 and are covered with plastic. The connecting wires for the thermal protection element 13 are connected to separate pins or tongues.

Figure 8:
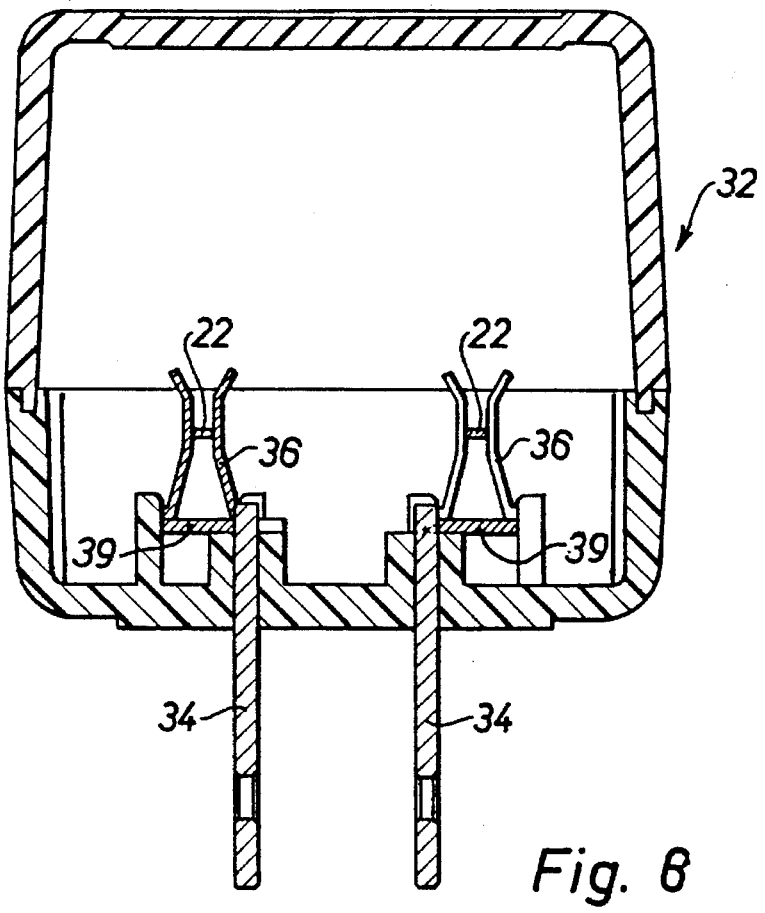
FIG. 8 shows a section along the line VIII—VIII of FIG. 7.
Figure 7:
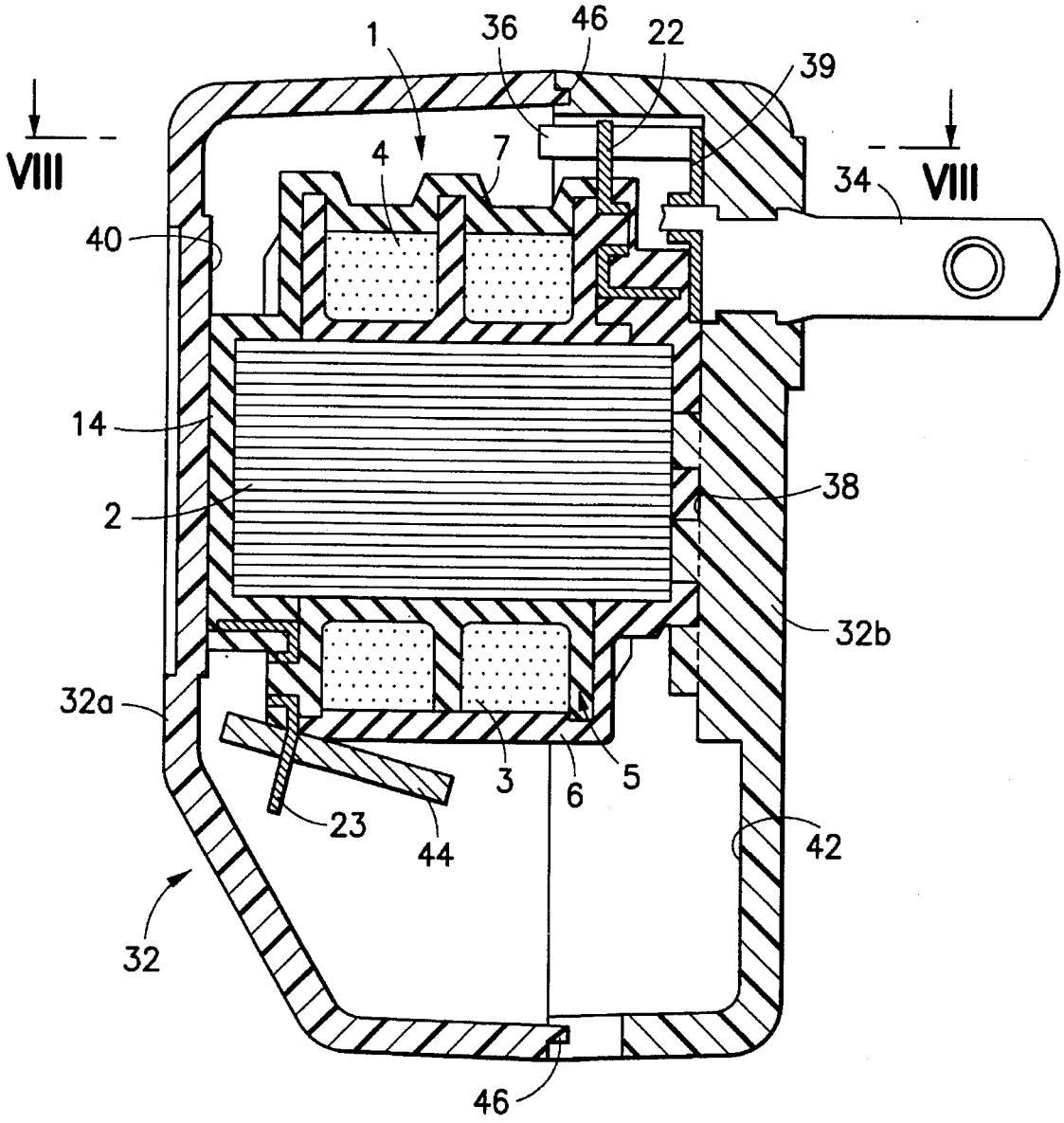
FIG. 7 shows a section through a mini-transformer build into a housing.

FIGS. 7 and 8 show a mini-transformer 1 of the type described, which is enclosed in a two-piece housing 32. The electrical connection with the conventional power supply is provided via a two-pole plug 34 which is rigidly connected with the housing 32. An electrical connection leads from there via electrical conductors 38 to two resilient metal clips 36, which provide an electrically conductive connection with the pins or tongues 22 extending from the mini-transformer 1. Fastening of the mini-transformer 1 in the housing 32 is made without screws by means of interconnecting pins and grooves 38 in one of the housing parts, namely the backside 42 of the housing (FIG. 7). On the opposite side of the housing, the mini-transformer 1 lies flush against the inner wall 40 of the other housing part. Ribs are provided in the housing interior for the lateral fixation of the mini-transformer 1, which laterally fix the iron core 2. An obliquely disposed plate 44 is provided as a conductor board to receive electrical components or the like. A cable, not shown, is connected to the pins or tongues 23 for take-off of the current with a voltage which normally is transformed down to low voltage.

The two halves of the housing 32*a*, 32*b* are kept together by means of interconnecting snap tongues 46, by screws or the like, or they are welded together.

The characteristics described make possible a particularly efficient production with small requirements for raw materials and semi-finished products. Furthermore, testing expenses and the amount of rejects can be reduced.

Various changes and modifications are possible within the scope of the inventive concept, and features of one embodiment may be combined with features of another embodiment.

I claim:

1. A method for producing a small or a mini transformer (1) comprising providing a unitary coil body (5) having a central aperture (20) with two lateral support walls (17, 19) and external core support ribs (10);

providing primary and secondary windings (3, 4) located on said unitary coil body (5), electrically and physically separated from each other; and providing a core (2) of ferromagnetic material, including a core element (2') which is generally E-shaped and having a central leg, and a further core element (2") positioned to complete the magnetic circuit of the core (2), said coil body being placed on the core with the central leg of the E-shaped core element (2') extending through the central aperture (20) of the coil body, said coil body, with the windings thereon, leaving hollow spaces (9) between the core (2) and the coil body (5), wherein the core (2) defines two broad end faces (52) and four side faces (54, 54') said four side faces defining two parallel longer sides (54') and two parallel shorter sides (54), at right angles to the longer sides, said method comprising the steps of injection-molding thermoplastic material over the coil body (5) with said windings (3, 4) thereon and over part of both broad end faces (52) of the core (2) to thereby form covers (6, 7) over the coil body and at least part of the broad end faces of the coil body;

said injection molding step further including injecting said thermoplastic material to fill said hollow spaces (9) between the windings (3, 4) and the core (2), completely filling said spaces, securing the windings (3, 4) in place on the core and insulating them against each other and against the core, while being unitary with said covers and forming first bars or connectors (12) arranged between and connecting said covers (6, 7) interiorly of the core (2);

injection-molding said thermoplastic material to overlap the end edges of said end faces (52) of said core (2), to form lateral connectors (8, 8') while leaving the side faces, free from said covers (6, 7), uncovered from injected material; and injection-molding said thermoplastic material in strip or bar form over the outside of said core to form strip or bar connectors (14, 14') arranged between and connecting said covers (6, 7) outside of the core (2), connecting said lateral connectors (8, 8') while overlapping portions of at least two of said side faces (54, 54') of the core and extending around the outside of the core, said lateral connectors (8, 8') and said strip or bar connectors (14, 14') forming with said covers (6, 7) a unitary plastic single structure of injected plastic material, while leaving the side faces (54) of the core between the strip or bar connectors (14, 14') essentially devoid of plastic material, said covers (6, 7) being clamped together by said first bars and connectors, (12) said lateral connectors (8, 8') and said strip or bar connectors (14, 14') to clamp the core (2) and the windings (3, 4) thereon therebetween.

2. The method of claim 1, wherein said injection of thermoplastic material forming the strip or bar connectors (14, 14') comprises injection-molding said thermoplastic material about the outer corners of the E-shaped core element (2') and the further core element (2'') to thereby leave the side faces (54) of the core essentially completely devoid of coverage by thermoplastic material.

3. The method of claim 1, wherein said injection of thermoplastic material strip or bar connectors (14) comprises injection-molding said thermoplastic material over the outside of the core (2) at the location of said lateral connectors to be unitary therewith whereby the material of the strip or bar connector (14, 14') will merge with the material of said lateral connectors (8, 8').

4. The method of claim 2, wherein said injection of thermoplastic material forming said strip or bar connectors (14) comprises injection-molding said thermoplastic material over the outside of the core (2) at the location of said lateral connectors (8, 8') to be unitary therewith whereby the material of the strip or bar connectors (14, 14') will merge with the material of said lateral connectors (8, 8').

5. The method of claim 1, wherein said injection of thermoplastic material forming said lateral connectors (8, 8') comprises injecting said thermoplastic material to overlap the end edges of said end faces (52) of the core (2) at the corners of the core (2).

6. The method of claim 1, wherein said injection of thermoplastic material forming said strip or bar connectors (14') comprises injecting said thermoplastic material in form of straps over at least two of said side faces (54, 54') of the core (2).

7. The method of claim 6, wherein said injection molding of thermoplastic material forming said lateral connectors (8, 8') comprises injection-molding said thermoplastic material at the location on said core of said strap-formed strip or bar connectors (14') to be unitary therewith, whereby material of the strip or bar connectors (14') will merge with the material of said lateral connectors (8, 8').

* * * * *